US007810569B2

(12) United States Patent
Hill et al.

(10) Patent No.: US 7,810,569 B2
(45) Date of Patent: Oct. 12, 2010

(54) METHOD AND APPARATUS FOR SUBTERRANEAN FRACTURING

(75) Inventors: Freeman L. Hill, Houston, TX (US); Jeffrey R. Honekamp, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 63 days.

(21) Appl. No.: 11/799,824

(22) Filed: May 3, 2007

(65) Prior Publication Data

US 2008/0271894 A1 Nov. 6, 2008

(51) Int. Cl.
*E21B 43/263* (2006.01)
*E21B 29/02* (2006.01)

(52) U.S. Cl. ..... 166/299; 166/55.2; 166/63; 166/177.5; 166/298; 166/307; 166/308.1

(58) Field of Classification Search ..... None
See application file for complete search history.

(56) References Cited

U.S. PATENT DOCUMENTS

| | | | | |
|---|---|---|---|---|
| 3,713,393 | A * | 1/1973 | O'Connor et al. | 102/202 |
| 4,512,406 | A * | 4/1985 | Vann et al. | 166/297 |
| 5,551,344 | A * | 9/1996 | Couet et al. | 102/312 |
| 5,775,426 | A | 7/1998 | Snider et al. | |
| 6,062,310 | A | 5/2000 | Wesson et al. | |
| 6,082,450 | A | 7/2000 | Snider et al. | |
| 6,336,506 | B2 | 1/2002 | Wesson | |
| 6,896,049 | B2 | 5/2005 | Moyes | |
| 7,134,506 | B2 | 11/2006 | Moyes | |
| 7,393,423 | B2 | 7/2008 | Liu | |
| 2001/0001418 | A1 * | 5/2001 | Wesson | 166/297 |
| 2003/0037692 | A1 * | 2/2003 | Liu | 102/301 |
| 2004/0040707 | A1 | 3/2004 | Dusterhoft et al. | |
| 2004/0231840 | A1 | 11/2004 | Ratanasiriguichai et al. | |
| 2006/0185839 | A1 | 8/2006 | Tiernan | |
| 2007/0272407 | A1 * | 11/2007 | Lehman et al. | 166/250.1 |

FOREIGN PATENT DOCUMENTS

| | | | |
|---|---|---|---|
| GB | 2403968 | A | 1/2005 |
| WO | 9604521 | A | 2/1996 |

OTHER PUBLICATIONS

International Search Report dated Dec. 2, 2008.
Zertech Z-Seal, Baker Oil Tools Zeroth Technology Ltd.,http://www.zertech.com/zseal.htm, (Article, undated. internet print date May 3, 2007).

* cited by examiner

*Primary Examiner*—Zakiya W. Bates
(74) *Attorney, Agent, or Firm*—Bracewell & Giuliani LLP

(57) ABSTRACT

A subterranean formation stimulation system, comprising a gas generator, a high pressure seal, and a fluid injection system. The high pressure seal may be a packer and or plug having an outer sealing surface on its outer periphery. The outer sealing surface is configured for metal to metal contact with the inner circumference of wellbore casing. The gas generator can be compressed gas or a propellant. A shaped charge can be included to activate the generator. The system is disposable in a wellbore on wireline, slick line, or tubing.

31 Claims, 11 Drawing Sheets

METHOD AND APPARATUS FOR SUBTERRANEAN FRACTURING

BACKGROUND OF THE INVENTION

1. Field of the Invention

The disclosure herein relates generally to the field of oil and gas production. More specifically, the present disclosure relates to a method and apparatus relates to the field of fracturing subterranean formations. Yet more specifically, the present disclosure concerns a method and apparatus of fracturing subterranean formations using a pressure producing apparatus disposable within a wellbore.

2. Description of Related Art

Stimulating the hydrocarbon production from hydrocarbon bearing subterranean formations may be accomplished by fracturing portions of the formation to boost fluid flow from the formation into a wellbore. One example of a fracturing process is illustrated in FIG. 1. In the embodiment of FIG. 1, tubing 10 is inserted into a wellbore 5 and terminates within the wellbore 5 adjacent a formation 14. Fracturing the formation, a process also known as fracing, typically involves pressurizing the wellbore to some pressure that in turn produces a fracture 18 in the formation 14. In the example of FIG. 1, a pressure source 8 is provided at surface that pressurizes fluid for delivery via the tubing 10 into the wellbore 5. A valve 12 is provided for selective pressurization of the wellbore 5. Packers 16 may be provided between the tubing 10 and the wellbore 5. Typically the inner circumference of the wellbore 5 is lined with wellbore casing 7.

The fluid being pressurized can be a completion fluid, but can also be a fracturing fluid specially developed for fracturing operations. Examples of fracturing fluids include gelled aqueous fluids that may or may not have suspended solids, such as proppants, included within the fluid. Also, acidic solutions can be introduced into the wellbore prior to, concurrent with, or after fracturing. The acidic solutions out from the inner circumference of the help create and sustain flow channels within the wellbore for increasing the flow of hydrocarbons from the formation. Packers and or plugs are sometimes used in conjunction with the pressurizing step to isolate portions of the wellbore from the pressurized fluid.

Some of the presently known systems use surface devices outside of the wellbore to dynamically pressurize the wellbore fluid. This requires some means of conveying the pressurized fluid from the pressure source to the region within the wellbore where the fluid is being delivered. Often these means include tubing, casing, or piping through which the pressurized fluid is transported. Due to the substantial distances involved in transporting this pressurized fluid, large pressure drops can be incurred within the conveying means. Furthermore, there is a significant capital cost involved in installing and using such a conveying system.

Other devices used in fracturing formations include a tool comprising propellant secured to a carrier. Disposing the device in a wellbore and igniting the propellant produces combustion gases that increase wellbore pressure to or above the pressure required to fracture the formation surrounding the wellbore. Ballistic means are also typically included with these devices for initiating combustion of the propellant.

BRIEF SUMMARY OF THE INVENTION

The present disclosure includes a wellbore hydrocarbon production stimulation system comprising, a housing formed to be disposed within a wellbore, a high pressure generator coupled with the housing, and a high pressure seal configured for placement within the wellbore. A shaped charge may optionally be included, where the shaped charge is configurable for perforating the wellbore and in some embodiments, for initiating gas generator operation. The high-pressure seal may comprise a packer as well as a plug. The outer surface of the high-pressure seal may be configured for mating engagement with the inner surface of a wellbore casing thereby creating a metal to metal seal capable of sealing against high pressure. A second high pressure seal may be included. The system may optionally include a carrier configured to receive an injection material, such as a proppant, sand, gel, acid as well as chemicals used for stopping water flow and during "squeeze" operations. Means for conveying the system in and out of a wellbore may be included, as well as a controller for controlling system operation.

Also disclosed herein is a method of stimulating wellbore hydrocarbon production comprising, disposing a high pressure generator in a wellbore, disposing injection material proximate the high pressure generator, and isolating the region of the wellbore surrounding the high pressure generator with a high pressure seal. The high pressure generator can be a propellant material as well as a volume of compressed gas. The method may further include adding a shaped charge for perforating a wellbore and for activating the high pressure generator.

DETAILED DESCRIPTION OF THE INVENTION

Disclosed herein is a system and method for the treatment of a subterranean formation. Treatment includes fracturing a formation and may also include stimulating hydrocarbon production of the formation. One embodiment of a system for formation treatment comprises a downhole tool having a carrier with a gas generator. Seals are included with the carrier between the carrier and a wellbore casing. The seals are capable of holding high pressure gradients that may occur axially along the length of the wellbore. For the purposes of discussion herein, a high-pressure gradient includes about 3000 pounds per square inch and above.

Figure 1:
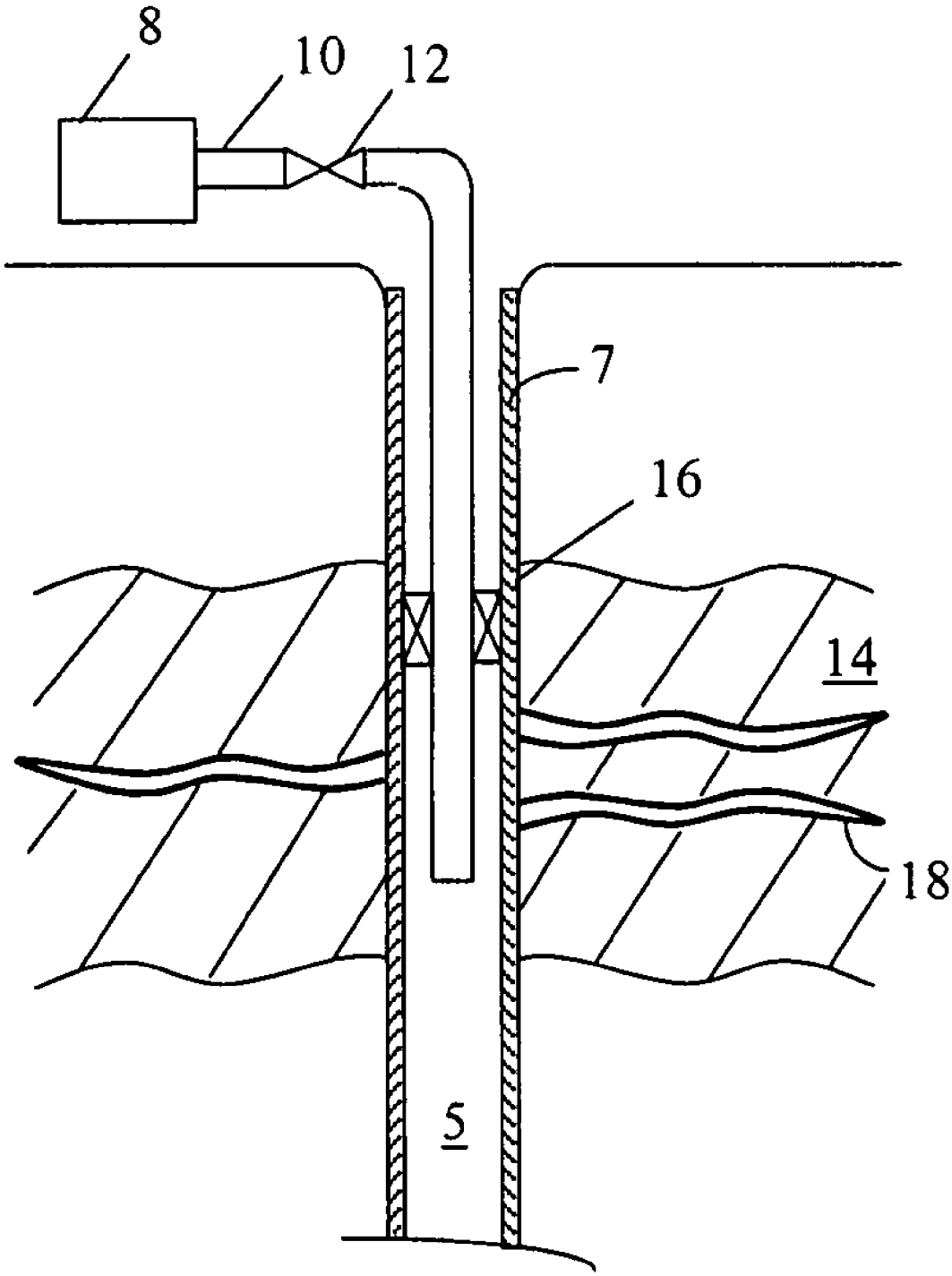
FIG. 1 (PRIOR ART)
FIG. 1 demonstrates in a partial cut-away side view, an example of a wellbore fracturing system.
Figure 2A:
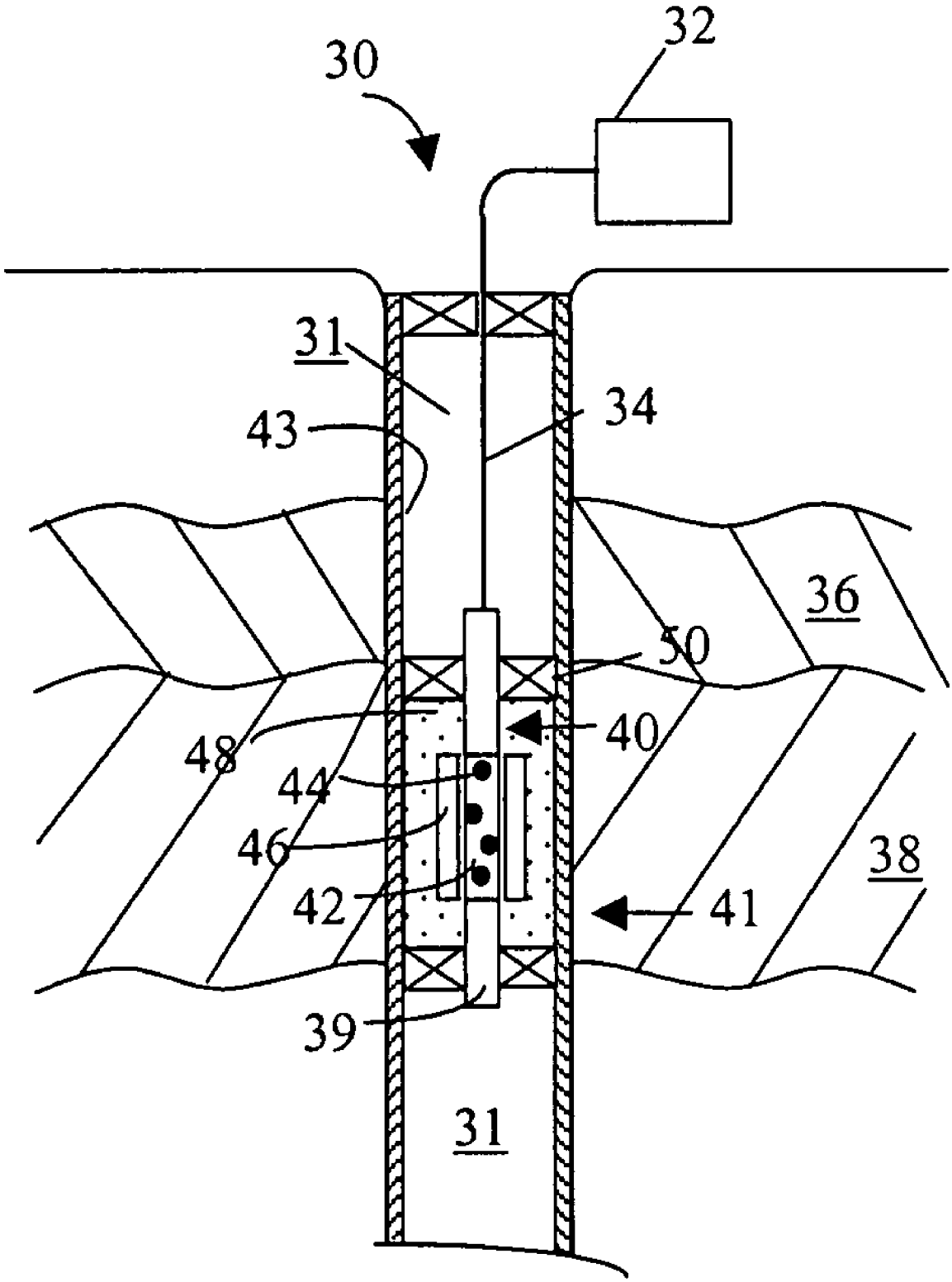
FIGS. 2*a*-2*d* illustrate in partial cut-away side views an example of a formation stimulation system and its steps of operation.

With reference now to FIG. 2*a* one embodiment of a formation treatment system 30 is provided in a side partial cut-away view. In this embodiment the system 30 comprises a downhole tool 40 disposable in the wellbore 31. The tool 40 is shown suspended within the wellbore by a conveyance means 34. The conveyance means may be wireline, slick line, tubing, coiled tubing, or any other apparatus useful for conveying downhole tools within a wellbore.

In the embodiment of FIG. 2*a*, the surface end of the conveyance means 34 is connected to a tool controller 32. The tool controller 32 may comprise a surface truck or other surface based equipment wherein operators may, via the conveyance means 34, lower, raise and suspend the tool 40 within the wellbore 31. As its name implies, control of the tool 40 within the wellbore 31 may also be accomplished by the tool controller 32 via the conveyance means 34. The controller 32 may comprise an information handling system (IHS). The IHS may include a processor, memory accessible by the processor, nonvolatile storage area accessible by the processor, and logics.

In the embodiment of FIG. 2*a* the downhole tool 40 comprises a carrier 39 on which a gas generator 46 is attached. An optional perforating section 42 is shown included with the carrier 39. Embodiments of the gas generator 46 include a propellant material and a vessel containing liquid or compressed gas. The propellant may have any shape, for example it may be configured into a sleeve-like shape that shrouds all or a portion of the carrier 39. Optionally, the propellant may comprise strips disposed about the outer surface of the carrier 39. The strips may extend axially along the carrier 39 or may be formed as one or more rings spaced along the carrier 39. The propellant may also be helically shaped and be positioned along the outer periphery of the carrier 39. Moreover the propellant may be mechanically affixed to the carrier or can be molded directly thereon. The propellant may be comprised of epoxy or plastic material having an oxidizer component such that the propellant may be ignited externally. One feature of the propellant is its continued oxidation even when suspended in a generally oxygen-free environment, such as within a fluid filled wellbore.

The perforating section 42 of the carrier 39 may comprise one or more shaped charges 44 disposed along the length of the carrier 39. As will be discussed in more detail below, the shaped charges 44 should be aimed at the gas generator 46 such that detonation of the shaped charge 44 can in turn activate the gas generator 46. For example, if the gas generator 46 is a fluid filled vessel, being pierced by a shaped charge will allow the fluid inside (either compressed gas or subcooled liquid) to rapidly escape. Alternatively, when the gas generator 46 comprises propellant material, shaped charge detonation can ignite the propellant 46. In addition to activating the gas generator 46, the shaped charges also create perforations in formations adjacent to the wellbore 31.

The embodiment of the system 30 as shown in FIG. 2*a* the tool 40 is suspended within the casing 43 of the wellbore 31. Placing the tool 40 within the casing 43 creates an annular space 41 between the downhole tool 40 and the inner wall of the casing 43. Seals 50 are disposed along the upper and lower portions of the tool 40 extending out into contact with the casing 43. Optionally however, a single seal may be provided either at the lower section or upper section of the carrier 39. The seals 50 are high-pressure seals capable of withstanding a pressure differential along their axis of at least 3,000 psi ($2.07\times10^7$ Pa.). The seals 50 may be integrally formed with the carrier 39 or strategically disposed within the casing 43 for contact with the carrier 39. Integrally forming the seals 50 with the tool 40 provides a degree of flexibility with regard to positioning the tool 40 at various depths within the wellbore casing 43.

Figure 4A:
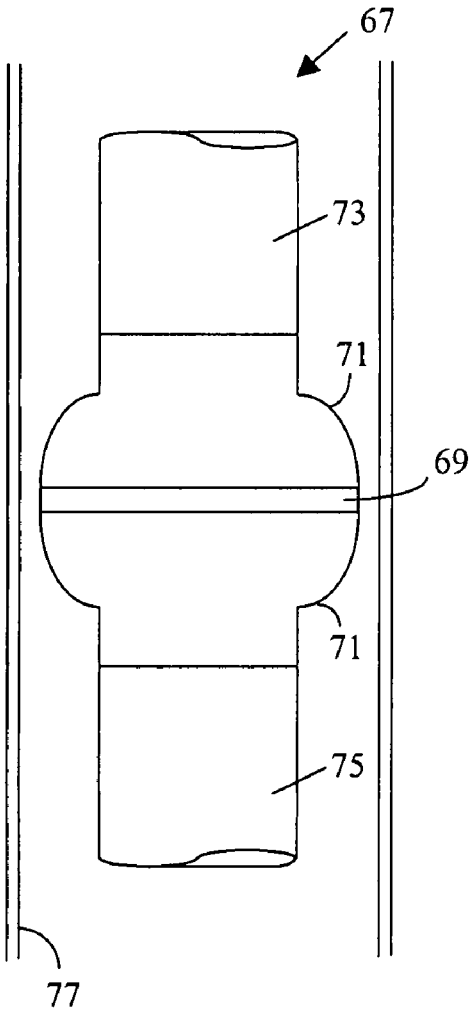
FIGS. 4*a* and 4*b* portray in side view an embodiment of a high pressure seal.
Figure 4B:
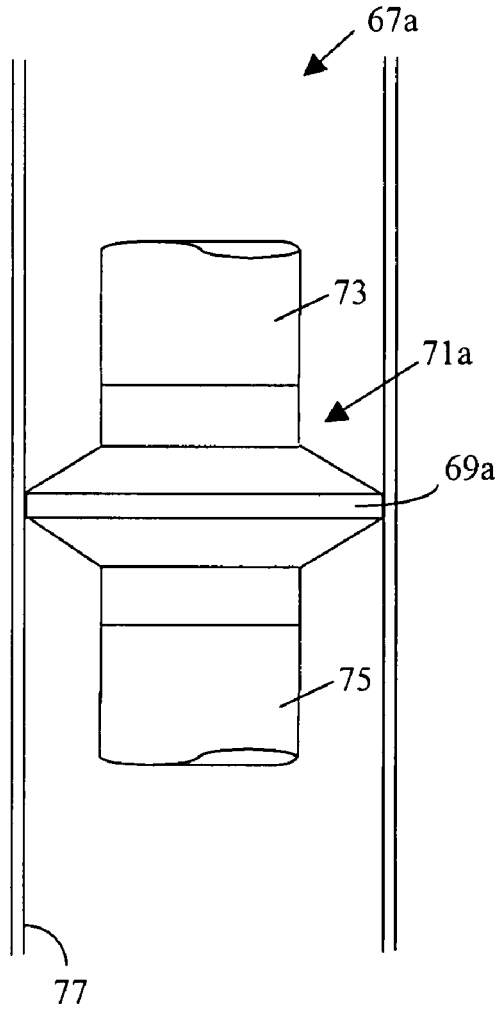

One example of a seal 50 suitable for use with the device as disclosed herein, can be found in Moyes, U.S. Pat. No. 6,896,049 issued May 24, 2005, the full disclosure of which is incorporated for reference herein. Another suitable seal comprises the Zertech Z-SEAL™ (patent pending) which is a high integrity, expandable metal, low profile, high expansion seal that is entirely non-elastomeric. FIGS. 4*a* and 4*b* illustrate in side view an optional seal embodiment disposed within a wellbore casing 77. The seal 67 comprises a deformable portion 71 axially disposed between tubulars (73, 75) with an outer sealing surface 69 that radially circumscribes the deformable portion 71. As seen in FIG. 4*b*, urging the tubulars (73, 75) together compresses the deformable portion 71*a* that outwardly radially extends the outer sealing surface 69. Continued compression of the deformable portion 71*a* urges the outer sealing surface 69*a* into sealing contact with the casing 77. The metal-to-metal contact of the outer sealing surface 69 with the casing 77 provides a high pressure seal capable of withstanding fracturing pressures without allowing leakage across the seal. The seal can also be decompressed which relaxes the outer sealing surface from the casing 77 and enables the tool (with the seal) to be removed from the wellbore and reused in subsequent operations.

Shown adjacent the downhole tool 40 and defined on its outer periphery by the casing 43 is a portion of wellbore fluid containing injection material 48. The injection material may include proppant materials such as gel, sand and other particulate matter, acids or other acidizing solutions, as well as combinations thereof. The injection material 48 may also include other chemicals or materials used in wellbore treatments, examples include compounds for eliminating water flow as well as materials used during completions operations such as a squeeze job. The material may comprise liquid or gas fluids, solids, and combinations. The injection material 48 can be inserted within the annular space 41, or can be disposed within a container that is included with the downhole tool prior to its insertion in the wellbore.

Figure 2B:
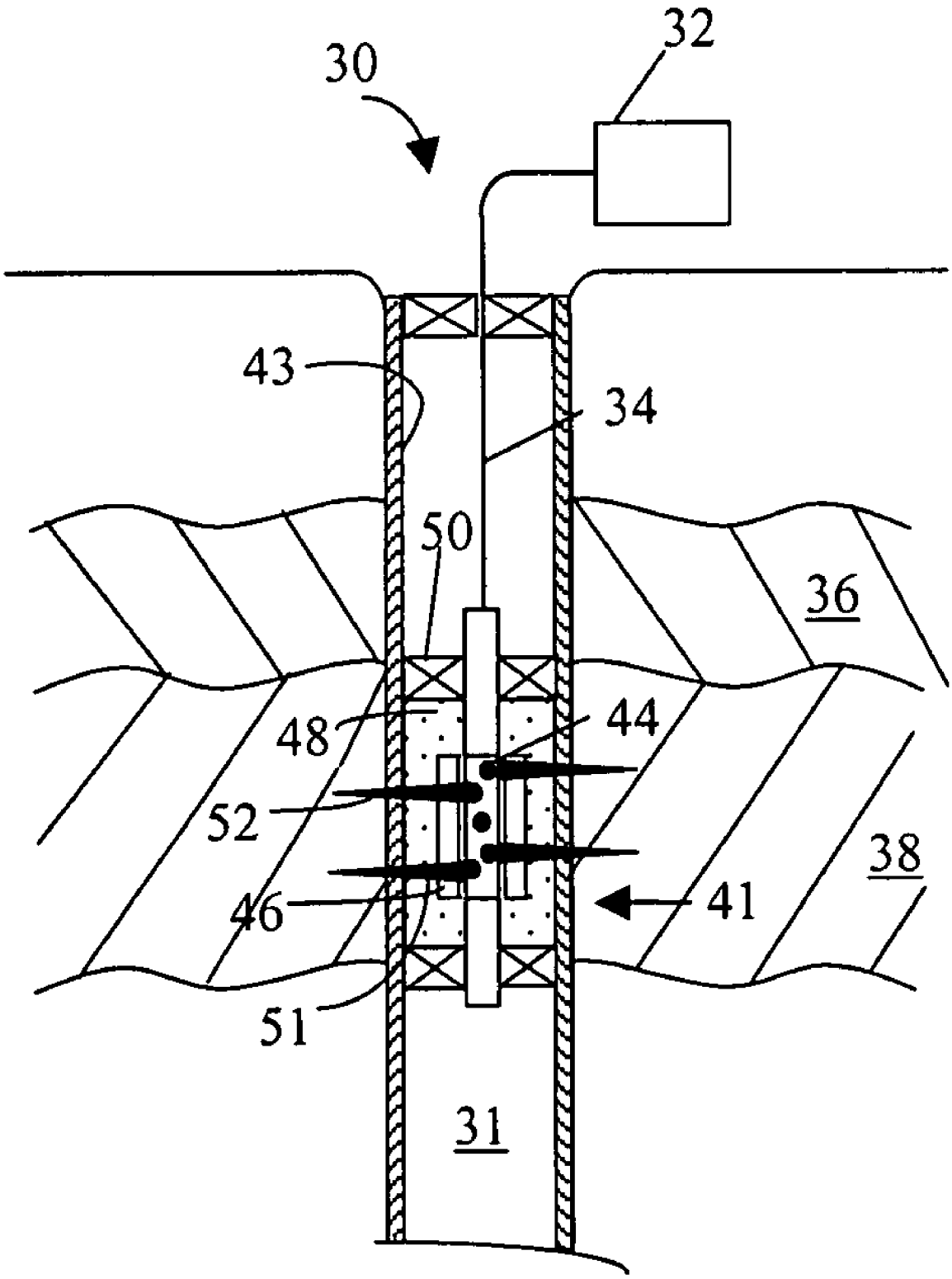

Examples of use of the treatment system disclosed herein are provided in the FIGS. 2*a* through 2*d*. As discussed, the system of FIG. 2*a* is shown lowered into a wellbore. It is well within the capabilities of those skilled in the art to dispose a downhole tool within a wellbore 31 proximate to a formation for fracturing and/or stimulation. FIG. 2*b* illustrates an embodiment of a treatment system 30 that includes an active perforating section 42 with shape charges 44. Here the shaped charges 44 are shown detonating and producing jets 51 that pierce the adjacent casing 43. The jets 51 further extend into the formation 38 thereby forming perforations 52 into the formation 38. In addition to perforating the casing 43 and formation 38, the jets 51 may be aimed to pierce the gas generator 46. In the embodiment of FIG. 2*b* the gas generator 46 is a propellant ignitable when exposed to the shaped charge jet 51. Optionally a detonating cord may be placed proximate to the propellant for igniting the propellant into its oxidizing state.

Figure 2C:
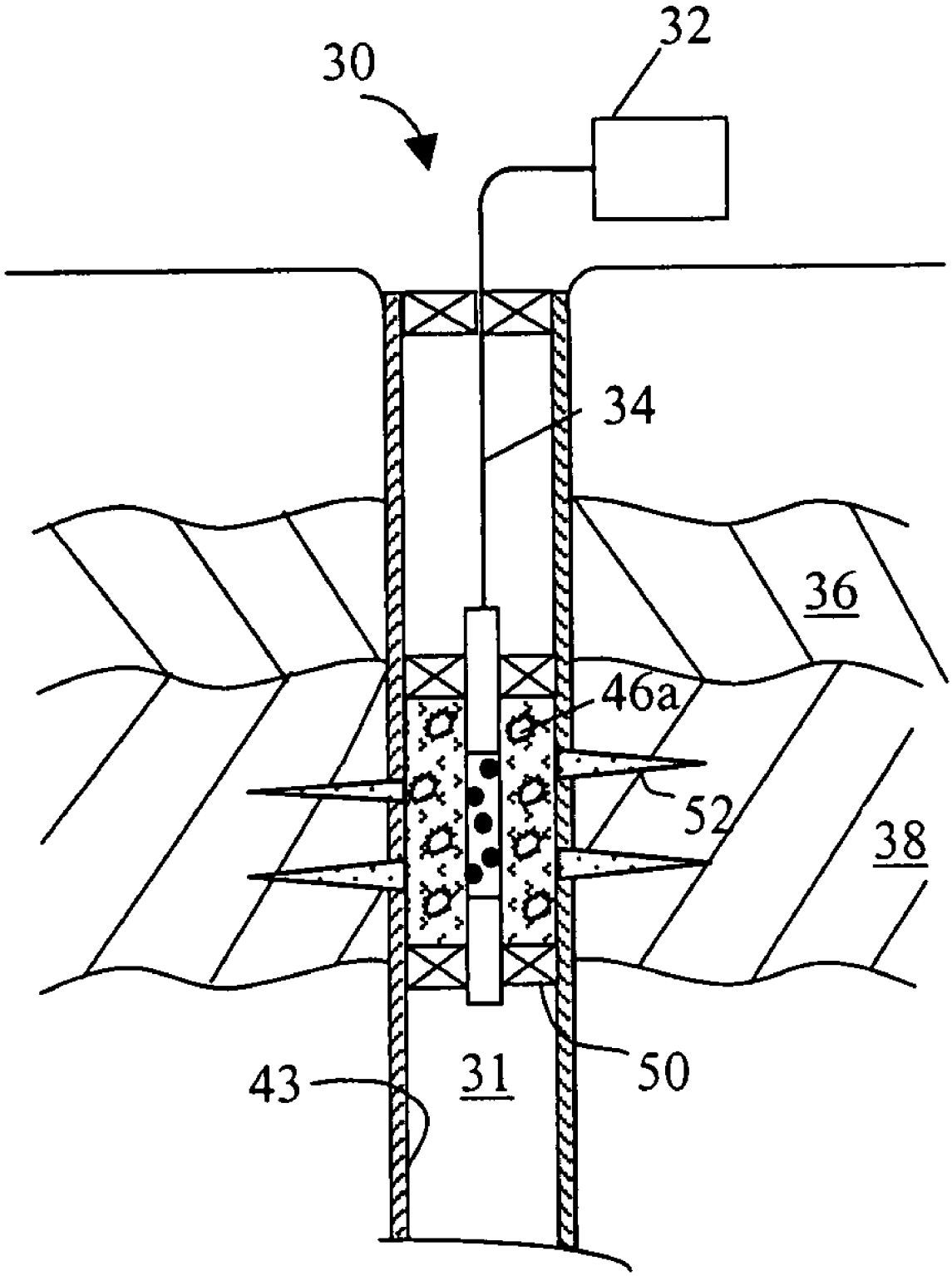
Figure 2D:
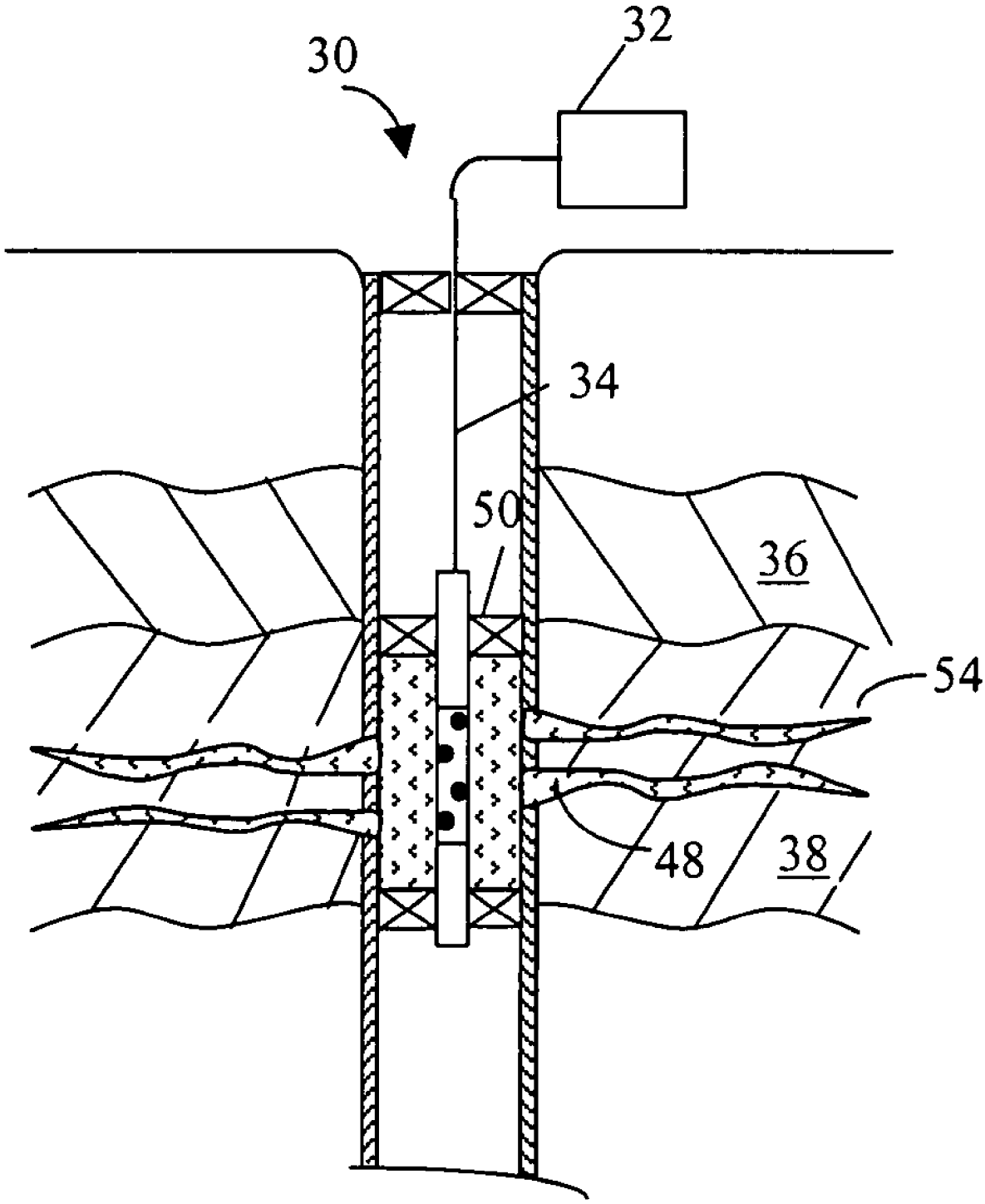

With reference now to FIG. 2*c* the propellant 46*a* is shown oxidizing within the annular space 41. During oxidation of the propellant 46*a* gas is released from the propellant and inhabits the annular space 41. The gas generation greatly increases the pressure within this portion of the wellbore 31. During propellant oxidation pressure in the perforations 52 is correspondingly increased that mechanically stresses that portion of the formation 38. The pressure induced stresses ultimately create fractures 54 that extend into the formation 38 past the terminal point of the perforations 52.

During fracturing the injection material 48 is carried from the annular space 41 into the fractures 54. Thus in situations when the injection material is a proppant its presence prevents collapse of the fracture after the fracturing high pressure is ultimately reduced. Additionally, if the injection material is an acid or acidizing solution, this solution can work its way into these fractures 54 and etch out material to stimulate hydrocarbon production.

FIGS. 5*a* through 5*e* illustrate the use of an optional embodiment of a downhole tool 40*b*. In this embodiment the tool is suspended within a wellbore 31 in communication with a tool controller 32*b* via the conveyance means 34*b*. As noted previously the tool controller may comprise a surface truck or other surface mounted equipment and the conveyance means 34*b* may comprise tubing, wireline, slick line, as well as coil tubing. In this embodiment the tool comprises various subs including a control sub 87, a propellant section 78, a carrier 80, a perforating section 82 and a lower portion 89. Additionally shown in a dashed line coaxially extending along the length of the tool 40*b* representing a detonation cord. The detonation cord extends on one end from the control sub 87 and terminates on its lower end at the perforation section 82. Included with the perforation section are shape charges 85 formed for detonating and creating a metal jet as is done in the art. An ignition means (not shown) may be included within the control sub 87 for initiating detonation of the detonation cord 83.

Figure 5A:
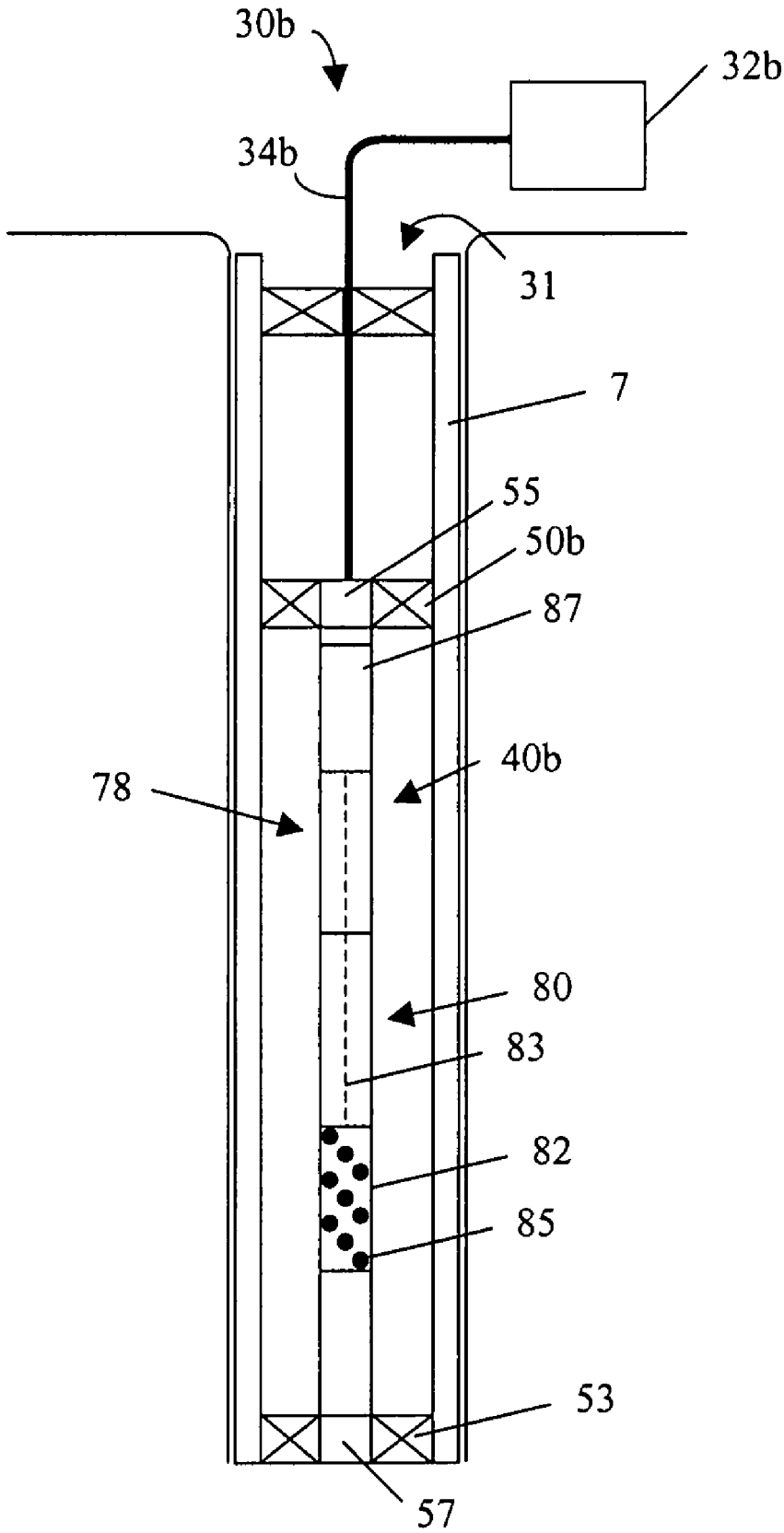
FIGS. 5*a*-5*e* are partial cut-away side views of a formation stimulation system and steps of operation.

In the embodiment of FIGS. 5*a* through 5*e* a pressure seal is provided at the upper and lower ends of the tool. In the embodiment of FIG. 5*a* a seal sub 55 having a high pressure seal 50 is provided above the control sub 87 and in sealing contact with the inner circumference of the casing 7. Suitable seals include those found in Moyes '049 as well as the Zertech packer. A lower seal 53 is also shown in the embodiment of FIG. 5*a*, where the lower seal 53 is capable of high pressure sealing. The lower seal 53 is provided on a lower seal sub 57 wherein the lower seal sub 57 is coupled adjacent the lower portion 89. This lower seal 53 may also be comprised of the aforementioned packers and alternatively may instead comprise a plug. Optionally, should the tool 40*b* be disposed at a depth sufficiently close to the bottom end of the wellbore 31, a bottom seal may not be necessary.

Figure 5B:
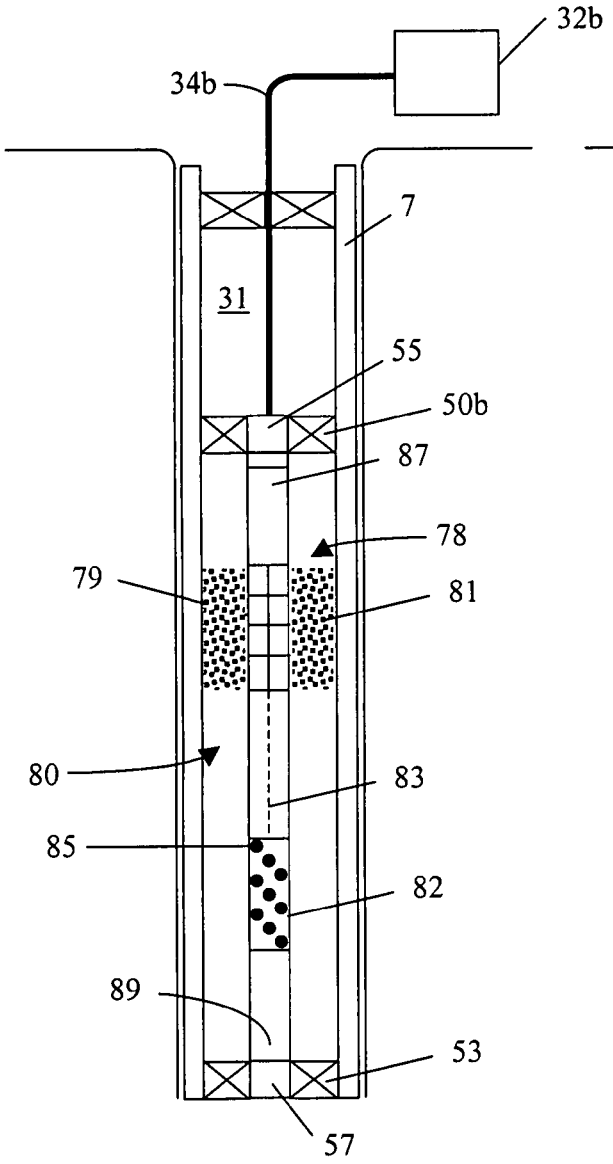
Figure 5C:
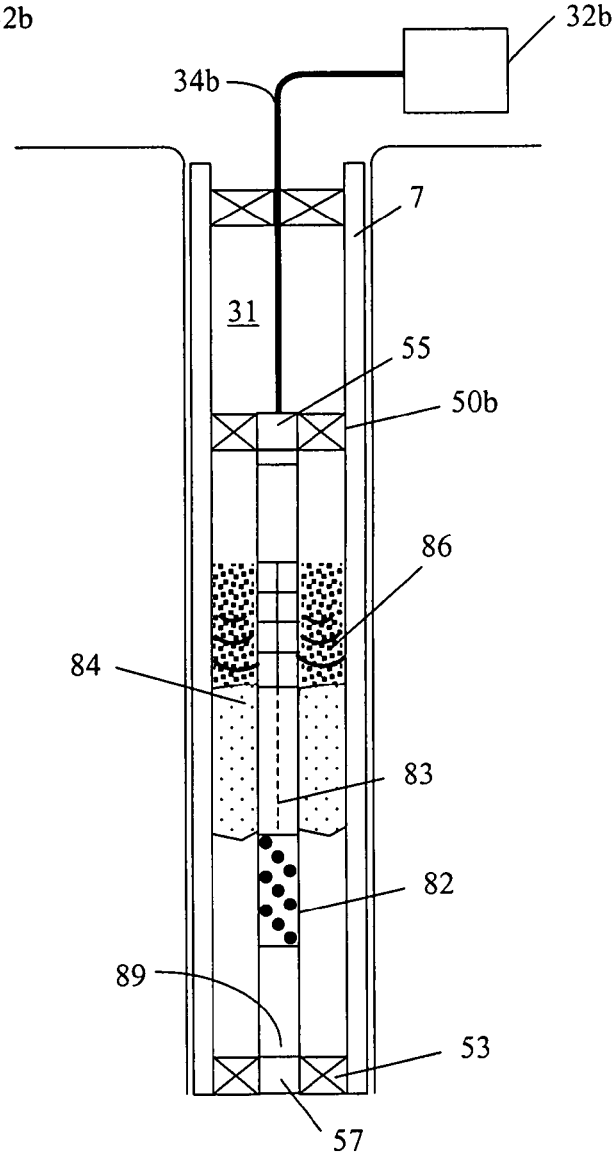

With reference now to FIG. 5*b* a partial cross sectional view of the tool 40*b* is shown with the tool disposed in the wellbore 31. One function of the tool 40*b* of FIGS. 5*a* through 5*e* is for creating perforations within a wellbore, extending those perforations through fracturing, and injecting an injectable material within these fractures. The fracturing is produced by causing localized high pressure within the wellbore 31 between the seals (50*b*, 53). The high pressure may be produced by combusting a propellant within the wellbore wherein the expanding gases in turn cause high pressure. In the embodiment shown the propellant section 78 comprises a propellant in communication with the detonation cord 83. As illustrated in the side perspective view of FIG. 6, the propellant section may be comprised of propellant material molded and pressed together in a cohesive body onto a frame 79. The igniter within the controller sub 87 may be activated for detonating the detonation cord 83 that in turn commences propellant combustion. As shown in FIG. 5*b*, portions of the combusting propellant 81 migrate out into the wellbore from within the body of the tool. The detonation wave continues downward past the propellant section 78 and onto the carrier 80. With reference now to FIG. 5*c* expanding gases formed by propellant combustion produce pressure waves 86 (shown in a curved wave form) that propagate through the wellbore fluid.

Figure 7:
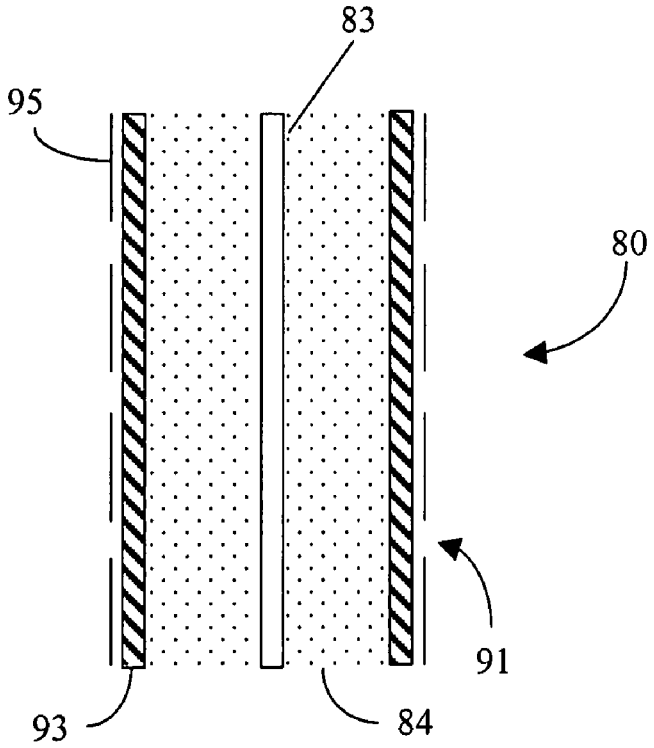
FIG. 7 is a cut-away view of a carrier portion of a downhole tool.

As shown, the carrier section 80 comprises a generally cylindrical shaped body coaxially disposed within the tool 40*b* between the propellant section 78 and the perforating section 82. The carrier section 80 provides a containment means for containing and carrying an injectable material (including the injectable materials as disclosed above). FIG. 7 provides a cross sectional view of an embodiment of a carrier section 80. Included within the carrier section 80 is a detonation barrier 93 frangibly responsive to the detonation cord shock wave. In one embodiment, the detonation barrier 93 comprises a ceramic or glass substance breakable when contacted by the shock wave. Removing the barrier allows the containment fluid within the carrier 80 to flow from within the tool 40*a* out into the wellbore 31. Apertures 91 are provided in the body wall 95 that allow for injectable material 84 to flow out from within the tool confines. The apertures 91 can take any form including circular, elongated slits, elliptical and the like.

Figure 5D:
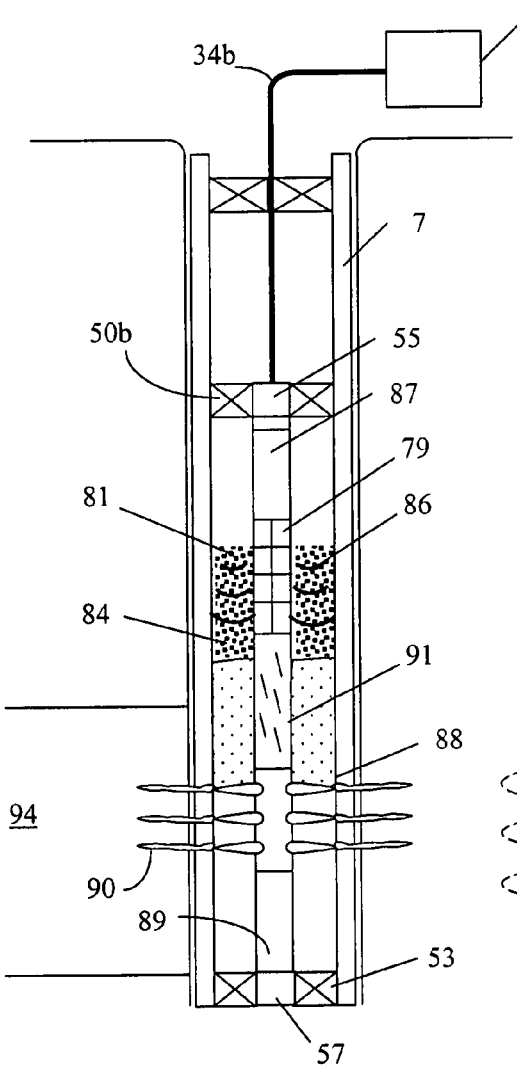
Figure 5E:
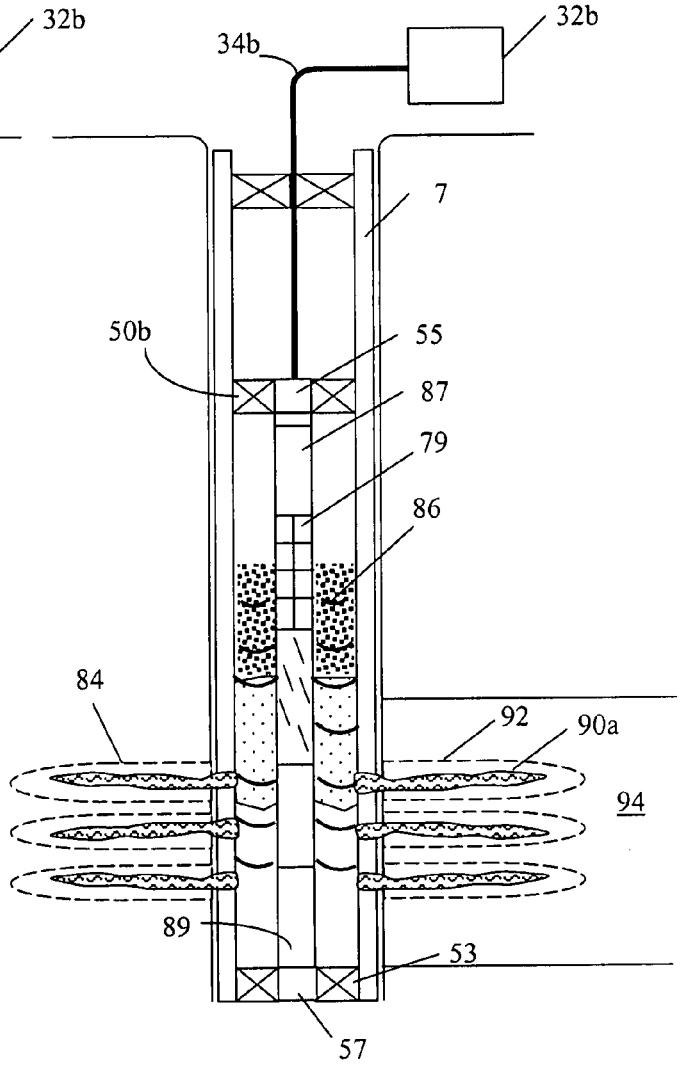
Figure 6:
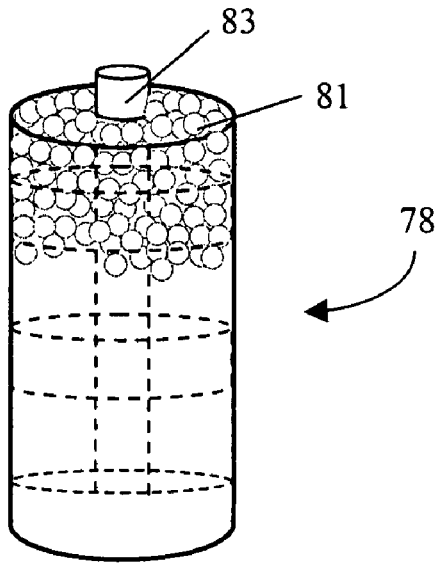
FIG. 6 is a perspective view of a propellant section.

Continued propagation of the detonation wave along the detonation cord 83 ultimately reaches the perforating section 82. As is known, the detonation wave initiates shape charge 85 detonation thereby producing the jets 88 that extend from the tool 40*a* through the casing 7 and into the surrounding formation. The detonation wave travel time within the detonation cord 83 is faster than the pressure wave produced by the propellant. Thus shaped charge detonation occurs before the wave reaches the perforation section. As shown in FIGS. 5*d* and 5*e* the pressure wave operates to first push the injectable material 84 downward and proximate to where the perforations are being formed. The pressure wave also causes fracturing within the formation as illustrated by the dash lines 92 surrounding the perforation. Further pressure wave 86 propagation in turn pushes the injectable material 84 into the perforations 90 formed by the shape charges 85. Continued propagation of these pressure waves also maintains perforation integrity for sufficient time to allow the injectable material 84 into the perforations 90. Thus, one of the many advantages of utilization of the tool 40*a* is the ability to increase perforation diameter and depth as well as enhancing production by fracturing.

Figure 3:
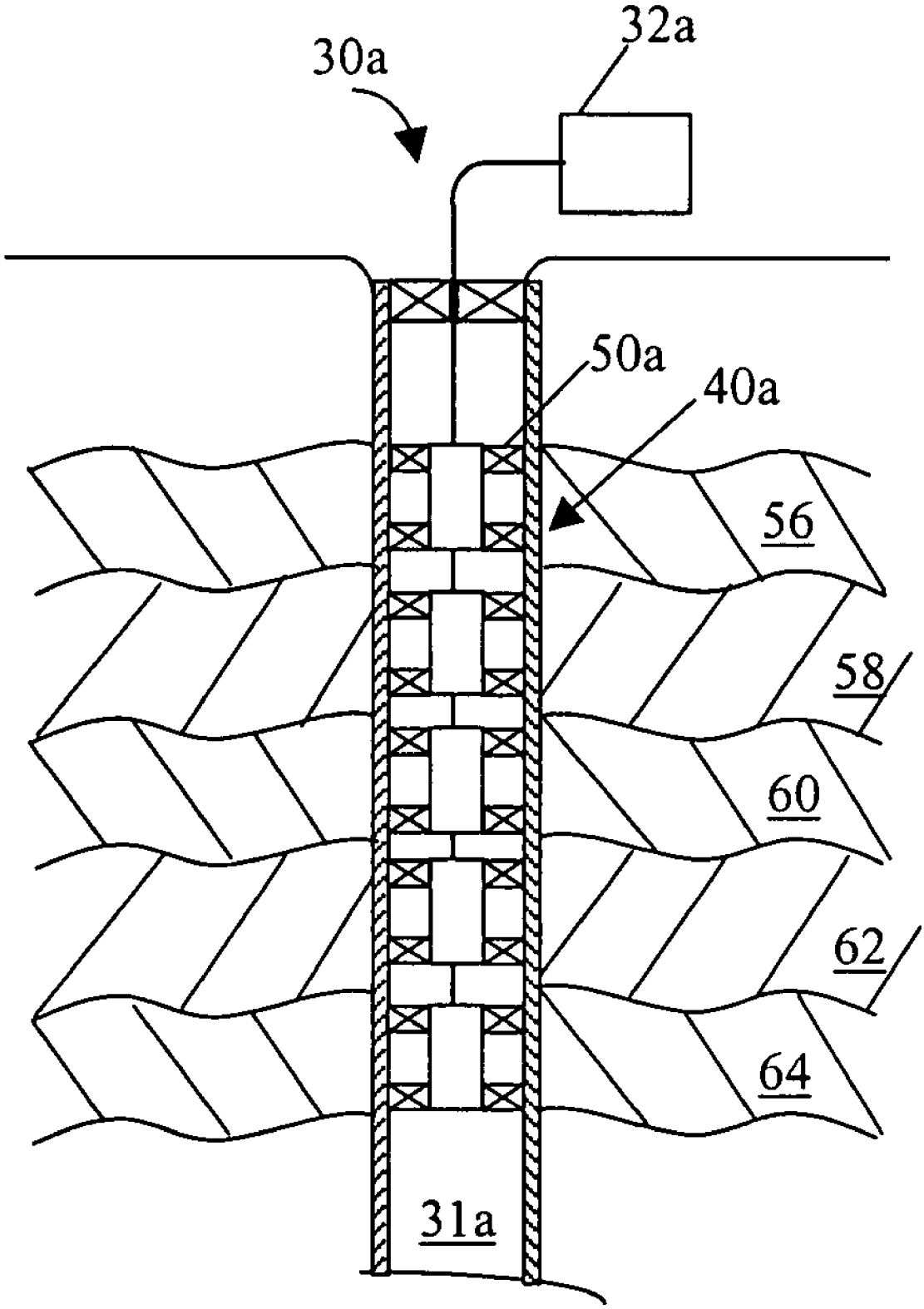
FIG. 3 demonstrates in partial cut-away side view an embodiment of a formulation stimulation system.

The system described herein is not limited to embodiments having a single downhole tool, but also can include a string of tools disposed within a wellbore. Employing multiple tools allows pressurization of various zones within the wellbore to distinct pressures. Moreover, the seals of each individual tool can accommodate pressure differentials that may exist between adjacent zones. FIG. 3 provides an embodiment of a treatment system 30*a*, wherein the system comprises multiple downhole tools 40*a* disposed within a wellbore 31*a*. In this embodiment high pressure seals 50*a* are included along the axial length of each of the downhole tools 40*a* for providing a pressure seal between the formations (36*a*, 38*a*, 56, 58, 60) that are adjacent each particular downhole tool 40*a*.

What is claimed is:

1. A wellbore hydrocarbon production stimulation system comprising:

a housing formed for placement within a wellbore thereby defining an annulus between the housing and the wellbore;

a wireline for conveying the system in and out of the wellbore;

a first high pressure seal coupled to the housing and selectively extendable into sealing engagement between the housing and the wellbore inner surface;

a second high pressure seal coupled to the housing and selectively extendable into sealing engagement between the housing and the wellbore inner surface; and a pressure generator provided with the housing between the first and second high pressure seals, so that when the first and second high pressure seals extend into sealing engagement with the wellbore inner surface and the pressure generator is activated the annulus is pressurized between the seals.

2. The system of claim 1, wherein the high-pressure seal is selected from the list consisting of a packer and a plug.

3. The system of claim 2, wherein the seal comprises a wall having a circumferential section configured to deform in response to an applied force.

4. The system of claim 3 further comprising another section and wherein one section is disposed on an inner surface of the wall and one section is on the outer surface of the wall.

5. The system of claim 2, wherein the packer seal further comprises an outer sealing surface disposed on its outer periphery.

6. The system of claim 5, wherein the outer sealing surface is configured for mating engagement with the inner surface of a wellbore casing thereby creating a metal to metal seal capable of sealing against high pressure.

7. The system of claim 1 further comprising shaped charges coupled with the housing, an injection material in the housing, and a selectively opened port in the housing between the injection material and the housing outer surface, the port disposed between the pressure generator and the shaped charges, so that detonating the shaped charges to create perforations from the wellbore, selectively opening the port thereby allowing the injection material to flow from the housing into the wellbore, and then activating the pressure source, pushes the injection material into the perforations.

8. The system of claim 1 wherein the pressure generator is selected from the list consisting of a propellant and compressed gas.

9. The system of claim 1 further comprising a shaped charge.

10. The system of claim 9, wherein the shaped charge is formed for initiating operation of the pressure generator.

11. The system of claim 1 further comprising a firing head.

12. The system of claim 1 further comprising injection material stored in the housing and a selectively opened port in the housing between the injection material and the housing outer surface.

13. The system of claim 12 wherein the injection material is selected from the list consisting of proppant, sand, acidic solution, and gel.

14. The system of claim 1, further comprising a controller.

15. A method of subterranean formation stimulation comprising:

providing a stimulation system comprising, a housing, a selectively activatable seal coupled with the housing, a selectively activatable high pressure source selected from the list consisting of propellant and compressed gas, and an injection material in the housing;

disposing the stimulation system into a wellbore that intersects the formation;

sealing between the stimulation system and the wellbore by using the seal to pressure isolate a portion of the wellbore;

pressurizing the isolated portion of the wellbore by activating the high pressure source; and releasing the injection material from the housing, so that the pressure from the high pressure source urges the isolation material into the formation.

16. The method of claim 15, wherein the system includes a second seal coupled with the housing on a side opposite the high pressure source, the method further comprising sealing between the housing and the wellbore with the second seal so that the isolated portion of the wellbore is adjacent the housing.

17. The method of claim 16, further comprising fracturing the subterranean formation using the pressure generated by the high pressure source.

18. The method of claim 17, wherein the high pressure produced by the high pressure generator urges the injection material into the fracture.

19. The method of claim 15, wherein the injection material is selected from the list consisting of proppant, gel, sand, and acid.

20. The method of claim 15, further comprising disposing a shaped charge in the wellbore aimed at the high pressure source.

21. The method of claim 15, wherein the seal comprises a high pressure seal apparatus that includes an outer sealing surface disposed on its outer periphery, wherein the outer sealing surface is configured for mating engagement with wellbore casing thereby creating a metal to metal seal.

22. The method of claim 15, wherein the stimulation system further comprises shaped charges, the method further comprising perforating the wellbore using the shaped charges, so that the injection material enters the formation through the perforations formed by the shaped charges.

23. A downhole tool for fracturing a hydrocarbon bearing formation comprising:

a housing;

a propellant coupled with the housing and circumscribing a portion of the housing;

shaped charges in the housing directed at the propellant;

a seal coupled with the housing and selectively extendable from the housing into sealing contact with the wellbore inner surface; and injection material disposed in the housing.

24. The downhole tool of claim 23 further comprising a wireline attachment.

25. The downhole tool of claim 23 wherein the injection material is selected from the list consisting of proppant, gel, sand, and acid.

26. The downhole tool of claim 23 further comprising a second seal on a side of the propellant opposite the first seal, the second seal coupled with the housing and selectively extendable from the housing into sealing contact with the wellbore inner surface.

27. The downhole tool of claim 23, wherein the seal is selected from the list consisting of a packer and a plug.

28. The downhole tool of claim 27, wherein the seal comprises a wall having a circumferential section configured to deform in response to an applied force.

29. The downhole tool of claim 27, wherein the packer seal further comprises an outer sealing surface disposed on its outer periphery.

30. The downhole tool of claim 29, wherein the outer sealing surface is configured for mating engagement with the inner surface of a wellbore casing thereby creating a metal to metal seal capable of sealing against high pressure.

31. The downhole tool of claim 30 further comprising another section and wherein one section is disposed on an inner surface of the wall and one section is on the outer surface of the wall.

* * * * *